US008591196B2

(12) United States Patent
Hardwicke

(10) Patent No.: US 8,591,196 B2
(45) Date of Patent: Nov. 26, 2013

(54) VIBRATION DAMPING NOVEL SURFACE STRUCTURES AND METHODS OF MAKING THE SAME

(75) Inventor: Canan Hardwicke, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1421 days.

(21) Appl. No.: 12/141,524

(22) Filed: Jun. 18, 2008

(65) Prior Publication Data

US 2009/0317236 A1 Dec. 24, 2009

(51) Int. Cl.
*F03B 3/12* (2006.01)

(52) U.S. Cl.
USPC ..... 416/241 R; 416/229 A; 416/232

(58) Field of Classification Search
USPC ..... 416/241 R, 229 A, 232
See application file for complete search history.

(56) References Cited

U.S. PATENT DOCUMENTS 4,380,574 A 4/1983 Gessinger et al.
5,775,049 A 7/1998 Fricke
5,924,261 A 7/1999 Fricke
2004/0018091 A1* 1/2004 Rongong et al. ..... 416/229 A
2005/0207896 A1* 9/2005 Gigliotti et al. ..... 416/241 R
2005/0214505 A1* 9/2005 Deakin et al. ..... 428/116
2006/0018760 A1* 1/2006 Bruce et al. ..... 416/229 A

OTHER PUBLICATIONS

Yin-Yu Chang et al, "Structural and Mechanical Properties of Nanolayered TiA1N/CrN Coatings Synthesized by a Cathodic ARC Deposition Process", Surface & Coatings Technology 200 (2005) 1702-1708.

* cited by examiner

*Primary Examiner* — Michael Lebentritt
(74) *Attorney, Agent, or Firm* — Nixon & Vanderhye P.C.

(57) ABSTRACT

A gas turbine or turbine component partially or fully coated with a damping surface layer. The damping surface layer may have a thickness between 0.1 and 2000 microns and may be capable of dissipating vibration or modifying a resonance frequency of the gas turbine or turbine component at ambient room temperatures including operational temperatures greater than 500° F., and the damping surface layer comprises at least one of (a) at least two layers comprising a first layer of at least one hard material and a second layer comprising at least one soft material, (b) a composite comprising a nickel alloy with a heat softenable chemistry, (c) a fine-grained nickel-based superalloy, or (d) a porous metallic coating, a porous metallic and ceramic coating, or a ceramic coating.

17 Claims, 5 Drawing Sheets

VIBRATION DAMPING NOVEL SURFACE STRUCTURES AND METHODS OF MAKING THE SAME

BACKGROUND OF THE INVENTION

The present invention generally relates to turbines and generally relates to surface structures that damp vibration of turbine components.

Operation of a turbine may subject many of the turbine's components to vibrational stresses. Vibrational stresses may shorten the fatigue life of components, thus potentially subjecting them to failure, especially when the components are also subjected to the harsh environment of a gas turbine.

One way to reduce vibrational stresses and extend the life of components may relate to damping the vibration of the component, thus potentially altering vibrational characteristics in such a way to increase its useful life. Mechanical damping mechanisms have been used to damp vibration of turbine components. Examples of the mechanical means include a spring-like damper inserted in a rotor structure beneath the airfoil platform, or a damper included at the airfoil tip shroud.

The phenomenon of damping may generally refer to the process of absorbing and converting the energy associated with a given oscillation into a different form of energy. Damping or energy dissipation can be caused by a combination of mechanisms depending on the mechanical structure (i.e. structural damping) as well as by a variety of mechanisms depending on the material's composition and processing conditions (i.e. material damping). All microscopic and macroscopic mechanisms taking place within the volume of a vibrating part and causing energy dissipation during operation may contribute to material damping.

The removed energy may be converted directly into heat or may be transferred to connected structures or ambient media. Micromechanisms causing internal damping in single or multiphase crystalline metallic materials may be called internal friction. In structural mechanics, it may be common to describe a structure in terms of modal parameters. Each mode corresponds to one degree-of-freedom and is characterized by a resonance frequency, a deformation vector and a modal damping. The structural response for a given force input may then be obtained by linear superposition of all modes. In the context of modal representation, structural damping is expressed in terms of modal damping values.

The desired properties of high strength, stiffness and tolerance to adverse environments appear to be at odds or even incompatible with high internal damping. Viscoelastic materials may show high damping capabilities but may be easily contaminated by their environment and usually must be applied as thick coatings since they unfortunately have insufficient strength properties. Thus the optimization of a damping treatment typically requires not only the proper choice of a damping material, but an understanding of the effects of the geometry of the damping treatment and the modal characteristics of the structure being damped.

Turbine components which might operate at high temperatures (e.g., up to 2500° F.), and/or corrosive/erosive environments, and/or under centrifugal loads must transition through structural resonance conditions to reach their operating envelope. Currently, there are no available adequate damping treatments which survive the turbine environment and do not sacrifice component integrity. U.S. Pat. No. 5,775,049 and U.S. Pat. No. 5,924,261 report Lodengraf materials with low sound speed to damp structural vibration and noise in advanced ship cabinets and electronics enclosures which are filled with granular materials like low density polyethylene beads, or lead shots which are not suitable for gas turbines. U.S. Pat. No. 4,380,574 reports a damping composite where a high damping metal surface layer is deposited on all sides of a poor damping base metal. Examples given are also not suitable for the harsh turbine environments. For example, high damping ferromagnetic alloys or magnetoelastic damping alloys (12Cr steel or Westinghouse's NIVCO10) are prone to fatigue cracking at 600° C. (1100° F.) due to precipitation of brittle intermetallic phases. Moreover, combining metallic base material and high damping surface layer is not ideal where there are large differences in their chemical and physical properties where the intended properties may be negatively affected due to metallurgical events (e.g. diffusional and kinetic processes) during operation. Thus, there may exist a need for good damping properties of surface architectures designed with good mechanical, thermal, and chemical strength.

In certain embodiments, there may be materials (and processes for the manufacture thereof) that possess high material damping under all operating conditions, that have good strength over the entire range of mechanical and thermal stresses, and that facilitate a wide range of construction and/or design of the components.

BRIEF DESCRIPTION OF THE INVENTION

In an aspect, at least one embodiment generally relates to a gas turbine or turbine component partially or fully coated with a damping surface layer. The damping surface layer has a thickness between 0.1 and 2000 microns and is capable of dissipating vibration or modifying a resonance frequency of the gas turbine or turbine component at ambient room temperatures including operational temperatures greater than 500° F., and the damping surface layer comprises at least one of (a) at least two layers comprising a first layer of at least one hard material and a second layer comprising at least one soft material, (b) a composite comprising a nickel alloy with a heat softenable chemistry, (c) a fine-grained nickel-based superalloy, or (d) a porous metallic coating, a porous metallic and ceramic coating, or a ceramic coating.

In a certain aspect, at least one embodiment generally relates to a method of making the gas turbine or turbine component partially or fully coated with a damping surface layer. The method may comprise depositing a layer on a surface of the gas turbine or turbine component using cathodic arc deposition, pulsed electron beam physical vapor deposition, slurry deposition, electrolytic deposition, sol-gel deposition, spinning, thermal spray deposition such as high velocity oxygen fuel, vacuum plasma spray, or an air plasma spray.

In an aspect, at least one embodiment generally relates to a gas turbine or turbine component partially or fully coated with a damping surface layer. The damping surface layer has a thickness between 0.1 and 2000 microns and is capable of dissipating vibration or modifying a resonance frequency of the gas turbine or turbine component at operational temperatures greater than 500° F. The damping surface layer comprises at least one of (a) Ti and AlTiN, (b) Cr and CrN, (c) TiN and Ti, (d) MCrAlY and a glass powder, where M comprises Ni, Co, or Fe, (e) a nanograined nickel-based superalloy, (f) a porous zirconium oxide, (g) a cracked zirconium oxide optionally with MCrAlY, (h) a porous MCrAlY, or a mixture thereof.

DETAILED DESCRIPTION OF THE INVENTION

Figure 1:
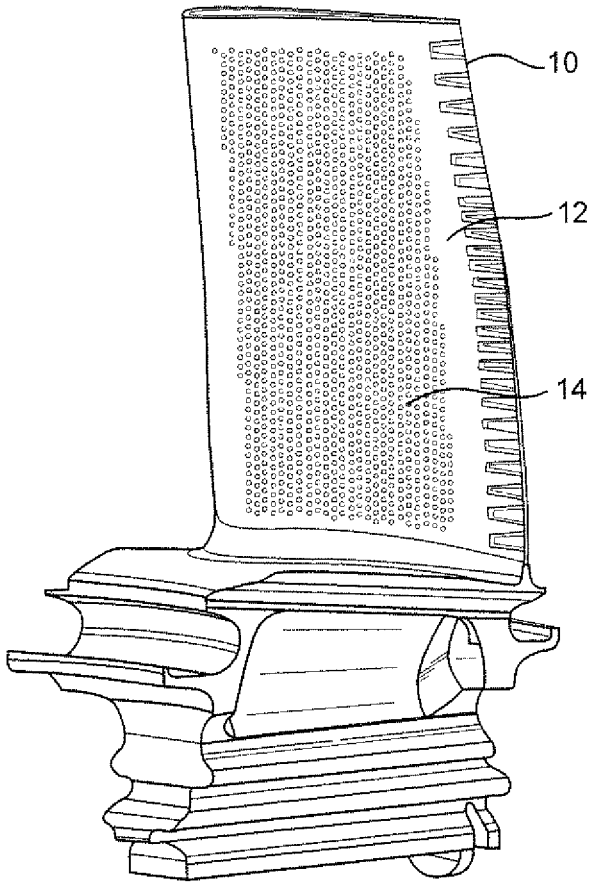
FIG. 1 is an example of an airfoil having damped vibrational characteristics in accordance with an embodiment of the present invention.

Several types of damping materials may exist. Natural composites (such as Fe—C—Si and Al—Zn alloys) may use a damping mechanism relating to viscous or plastic flow across phase boundaries between the matrix and the second phase. Ferromagnetic alloys (such as Fe, Co, and Ni, Fe—Cr, Fe—Cr—Al, Co—Ni—Ti, and Co—Ni—Fe) may use a damping mechanism relating to magneto-mechanical static hysteresis due to irreversible movement of ferromagnetic domain-walls. Alloys based on dislocation damping (such as Mg, Mg-0.6% Zr, Mg—Mg2Ni) may use a damping mechanism relating to static hysteresis due to the movement of dislocation loops, breaking away from pinning points. Alloys with movable twin or phase boundaries (such as Mn—Cu, Mn—Cu—Al, Cu—Zn—Al, Cu—Al—Ni, Ti—Ni, and NiTi—Co) may use a damping mechanism relating to the movement of twin boundaries, martensite-martensite boundaries, and boundaries between martensite and the matrix-phase.

In general, the diversity and ambiguity of damping units has considerably complicated collecting, checking and correlating test data. Element parameters, system parameters, and material parameters can be the measures of damping. Element parameters depend not only upon the material but also on the size and shape of the test specimen, as well as on the stress distribution brought about by the method of loading. This category of parameters may include the equivalent stiffness and viscous damping constant. System parameters depend upon the various elements taking part of the system as a whole. Many characteristics of a vibrating system, including natural frequency, damping ratio, quality factor and logarithmic decrement may be classified within this category. Material parameters may depend only upon the composition and treatment of the material and are independent of the dimensions of the considered test element.

A useful material parameter may be the dimensionless loss factor. The loss factor of a uniform material may be defined as the ratio of the energy dissipated during one cycle of simple harmonic stress (without any pre-stress) to the maximal strain energy stored in the material during the cycle. A higher value of a loss factor may be desired for a good damping surface layer with respect to the untreated base material.

In the past, cast iron has been regarded as the structural material with the highest internal damping. The actual loss factor of some special cast irons can be as high as 3%, but is still far too small to improve significantly the overall damping of built up structures. For linear mechanisms, loss factors may be independent of stress amplitude and are generally found to be dependent on frequency and temperature. In addition to desired high loss factor for the surface damping layer, a higher elastic modulus of the surface layer may be needed for the layer to take on the vibrational energy with respect to the base material.

To prevent turbine failures due to component vibration, the excited resonant response should be attenuated to an acceptable level. Vibration suppression may entail applying a free layer damper (i.e., addition of a surface functional layer (such as coatings) with the right material and microstructural features to dissipate vibrational energy) to the component subjected to vibration. The size and the planned operation of the turbine may also affect component vibration characteristics which can cause reduced fatigue life.

In certain embodiments, this invention involves the application of a surface layer (0.1-2000 microns (and all subranges therebetween), preferably 0.25-500 microns (and all subranges therebetween), and more preferably 1-100 microns (and all subranges therebetween) thick or thickness much less than component wall thickness) with the right microstructures to absorb and dissipate vibration or modify the resonance frequencies of a vibrating component. The damping surface layers may be applied partially or fully on the airfoil surfaces (or other surfaces within a turbine).

One or two same or different materials in the form of a thin coating layer may be applied in layers varying in thickness or application process. And the coatings may be applied to any vibrating component in any machine. For example, coatings applied to airfoils particular to a compressor or turbine section of a gas turbine may be applied to components in the combustor section as well.

Surface structures for turbine components, for example, gas turbine components, are disclosed which provide vibration damping at room temperature and above by absorbing vibration of the components and/or altering resonance frequencies of the components. These components (which may be referred to base materials) may be ferrous alloys, steels, superalloys, and titanium alloys, ceramic matrix composites (CMCs), etc. The vibration damping may increase fatigue lives of the components, for example, airfoils, compared to undamped components. Such surface structures may similarly be utilized to provide other forms of damping, for example, sound damping.

FIG. 1 schematically illustrates a gas turbine component, for example an airfoil 10 with enhanced vibration damping. The airfoil 10 includes an airfoil substrate 12 and a surface structure 14 applied to the airfoil substrate 12. Surface structure 14 may contain one or more surface layers with varying properties. The surface structure 14 provides vibration damping when applied to the airfoil substrate 12. Embodiments of vibration damping surface structures 14 may affect changes in chemical, structural, and/or mechanical properties of at least one component of the surface structure 14 to provide the vibration damping characteristics at temperatures involved in the operation of a turbine.

Vibration damping treatments for low- to mid-temperature applications (e.g., less than 400° F.) may primarily consist of viscoelastic polymeric materials (VEM) with low modulus and high loss factor. VEMs may work when the treatment thickness is significantly greater than the base material thickness. It is believed that no successful higher temperature damping treatments have been reported for turbine applications. At elevated temperatures, pressures, and/or centrifugal loading conditions, there may be a harsh environment requiring surface layers to simultaneously dampen vibration and survive operating conditions.

For gas turbine applications (for example, compustor and/or turbine), the requirements for surface layers are modified for survival up to 2000° F. at thicknesses much less than the base material thickness. Materials for good damping may require simultaneous high modulus and high loss factor requirements, driving towards combination of metallic and/or ceramic compositions with inherent or engineered hysteresis. Certain embodiments of this invention generally relate to high temperature (e.g., 1400° F.) capable, thin, and effective vibration damping layers (metallic, ceramic, or composite), as metallurgical cross sections are illustrated in FIGS. 2, 3, 4, and 5. Testing was conducted on treated and untreated base flat plates and results are reported in FIGS. 6-8.

Certain aspects of the present invention included selecting candidate surface layer materials and microstructures suitable for 1400° F. maximum operation (e.g. damping in addition to oxidation, erosion, and corrosion resistance), applying these coatings on stainless steel and nickel substrate plates for performance screening as compared to the uncoated plates. Loss factor (material property) and the modulus data may be determined as a function of temperature, strain level, and strain state for different modes of vibration.

A significant increase in treated substrate-metal material damping at elevated temperatures may be obtained through processing sequential, thin layers of hard and soft materials, composites of nickel alloys with heat softenable chemistries, fine grained nickel based superalloys, and/or porous metallic and/or ceramic coatings. Each system was found to significantly improve base material damping when compared to untreated, bare material. Surface layer microstructures and architectures are represented in FIGS. 2-5. In certain embodiments, the present invention may relate to the use of one or more of these layers together to tailor to desired properties.

Various alloys may be used in exemplary embodiments of the present invention. These alloys may be suitable for exposure to temperatures at or greater than 1400° F. These surface layers were applied to AISI304 stainless steel and also nickel based superalloy (GTD111 and GTD444) substrate plates using various methods. It is believed that the damping properties may be optimized by systematically varying these surface layer materials and process parameters.

Figure 2:
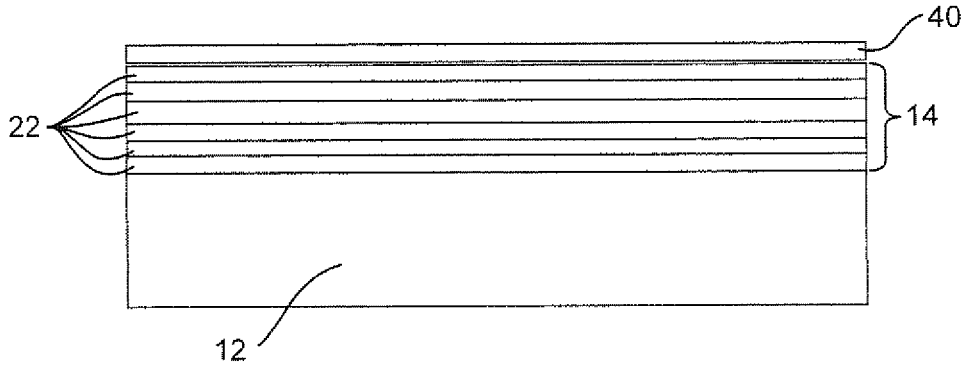
FIG. 2 is an illustration of an example of a coating's metallurgical cross section in accordance with an embodiment of the present invention.

In various exemplary embodiments, thin (microns or submicrons thick) individual layers of soft and hard materials are sequentially deposited onto AISI304 or GTD111 plates in vacuum. The interfaces between different layers of metal (soft)/ceramic (hard) layers may act as vibration dissipating boundaries. Surface layers less than total 4 mils thick (100 microns) CrN/Cr, TiAlN/Ti, and TiN/Ti, TiAlCrSiN/Cr, NiAlCrSiN/NiCr architectures (the layer thicknesses can be varied as well) processed, but not limited to, using cathodic arc or ion plasma methods may be effective in vibration damping. Suitable coatings may be supplied by NorthEast Coating Technologies, Maine. Of course, depending on temperature requirements, the oxidation resistance of the surface layers can be improved by adding alloying elements to the compositions above, or using completely different chemistries with alternating mechanical properties. An exemplary cross-section is shown in FIG. 2.

Figure 3:
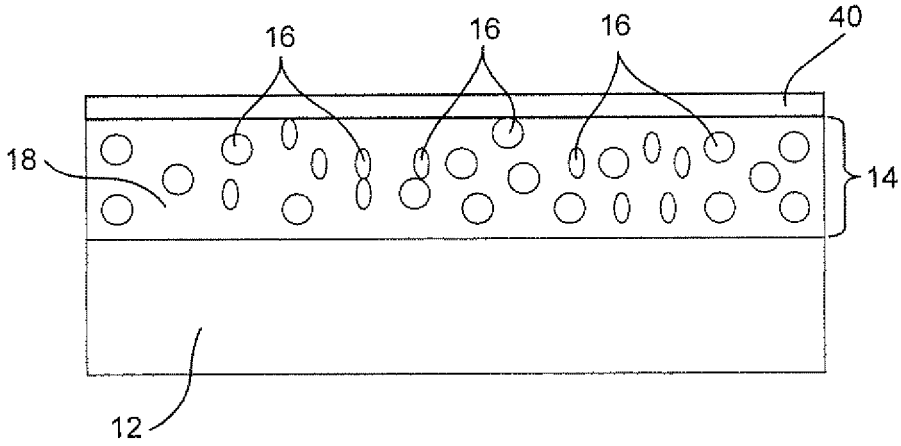
FIG. 3 is an illustration of another example of a coating's metallurgical cross-section in accordance with an embodiment of the present invention.

In various exemplary embodiments, oxidation resistant metallic or ceramic powders are mixed with heat softenable particles such as glass, then thermally sprayed onto the AISI304 and GTD111 plates to form a coating by High Velocity Oxygen Fuel (HVOF) process. Glasses may be amorphous oxides and may typically show a gradual softening from amorphous solid to liquid phase through a transition temperature. At the temperatures of interest, the viscosity of the glass is reduced as the temperature is increased and the glass composition selected and/or the many glass/metal interfaces keep absorbing vibration, even at or greater than 1400° F. In certain embodiments, SM4198 powder (MCrAlY, where M is Ni, Cu, and/or Fe) (from Sulzer Metco) is mixed and thermally sprayed with 10%, 30%, or 50% Spheriglass 3000E, or Spheriglass 3000 and Q-Cel 6070 (all from PQ Corporation) to 2-80 mil thickness. As the amount of glassy phase in the metal matrix increases, the damping capability may also increase. An exemplary cross-section is shown in FIG. 3. It was also found that the amount of damping at temperature can be tuned with the type of glass used.

In various exemplary embodiments, a porous or intentionally vertically cracked zirconium oxide may be deposited by atmospheric (air) plasma spraying (APS) over a metallic coating (for example, Sulzer Metco's SM4198) deposited by HVOF to a total thickness of 5-80 mils. This porous surface layer can also be sandwiched in between these HVOF metallic layers which also provide adhesion and grades thermal expansion of base material to the to ceramic surface layer. Metallic or ceramic microballoons (e.g. hollow spheres) can also be used to create the pores in metallic or ceramic matrices; or a metallic or ceramic open cell foam material (such as from Porvair, Inc.) can be used as a damping surface layer. The combination of these coating microstructures may also provide good results. It is also conceived that these microstructures with pores and intentional cracks can be filled with heat softenable phases to attain desired level of damping. Exemplary cross-sections are shown in FIG. 4.

Figure 5:
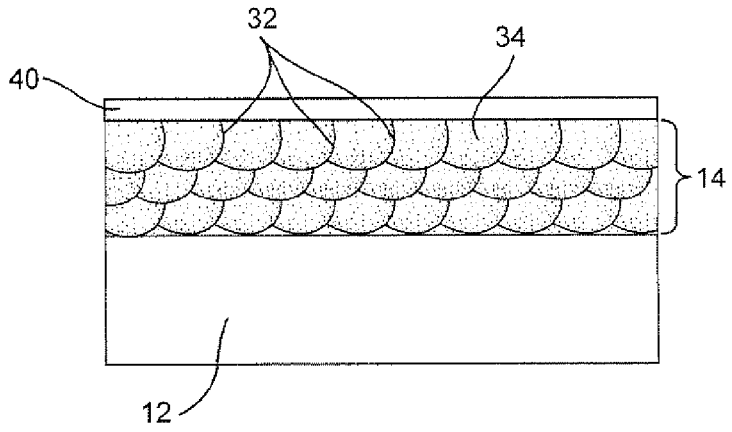
FIG. 5 is an illustration of a fourth example of a coating's metallurgical cross-section in accordance with an embodiment of the present invention.

In various exemplary embodiments, ultra-fine grained (sub-micron boundaries containing pinning particles) and oxidation and corrosion resistant metallic powders (such as nickel-based superalloy Rene108 or Rene104) may be deposited. These surface layers may be formed by thermally spraying (such as by HVOF) nickel based powders which were cryomilled (mechanically milled in liquid nitrogen) before deposition. Mechanical milling may impart sub-grains (at least 30 times smaller grains) in powder particles which also contain very small (3-5 nanometers) dispersoids containing Fe, N, and/or O. These coatings may also be effective in vibration damping, possibly due to the very many grain boundaries and fine, dispersions absorbing and dissipating vibration. An exemplary cross section is shown in FIG. 5.

It is also conceived that these four general types of good high temperature damping surface layers may be used together in any combination to adjust or modify desired damping characteristics.

The following table (Table 1) illustrates various exemplary, non-limiting embodiments:

TABLE 1

Various exemplary embodiments of coatings within certain aspects of the present invention.

| Example No. | Starting materials | Composition | Application Method/Process Description | Preferred Thickness |
|---|---|---|---|---|
| 1 | Ni alloy powder and glass powder mixture | Full 10% Glass Mix, 30% mix, sandwich, 50% glass | MCrAlY (where M is Ni, Co, or a mixture thereof) is | 2-80 mils |

TABLE 1-continued

Various exemplary embodiments of coatings within certain aspects of the present invention.

| Example No. | Starting materials | Composition | Application Method/Process Description | Preferred Thickness |
|---|---|---|---|---|
| | | | mixed with glass and HVOF processed. Mixture amounts, type of glass, layering architectures can be varied to tune damping. | |
| 2 | intentionally cracked ceramic top coat on metallic coating on base material | zirconia + MCrAlY (GT33) | HVOF bond coat + APS top coat | 10-80 mils |
| 3 | porous ceramic and metal layers (sandwich) | GT33/porous zirconia/GT33 | HVOF GT33 + Porous TBC+ HVOF GT33 | |
| 4 | intentionally cracked ceramic coating | 7%, 14% zirconia | EB PVD | 2-10 mils |
| 5 | composite coating | MCrAlY + BN; MCrAlY + $ZrO_2$ + BN + MCrAlY | APS (GT50 metallic), GT50 sandwiched GT33; APS (GT60 ceramic), GT60 sandwiched GT33 | 3-80 mils |
| 6 | multiple microlayers | 1Ti + 4AlTiN; 0.5 Ti + 1 AlTiN; 4.9 μm CrN + 1 μm Cr; 1.6 μm CrN + 1.1 μm Cr | Ion plasma (cathodic arc) | 0.01-2 mils |
| 7 | nanograined metallic | Rene108, Rene104 | HVOF of cryomilled powder | 2-80 mils |

Deposition of multilayered coatings by cathodic arc is reported in Y.-Y. Chang et al., Surface & Coatings Technology 200 (2005) 1702-1708. Seven types of surface layers and corresponding compositions are reported in Table 1. These may be modified to improve high temperature properties beyond 1400° F., e.g., as long as the thermal expansion coefficients can be matched with the surface layers and the base material. Also, an optional layer of protective metallic, ceramic, or composite coating can be deposited onto these vibration damping surface layers or any combination of these seven types of damping layers can be applied on a vibrating gas turbine component (compressor, combustor, or turbine sections).

Figure 6:
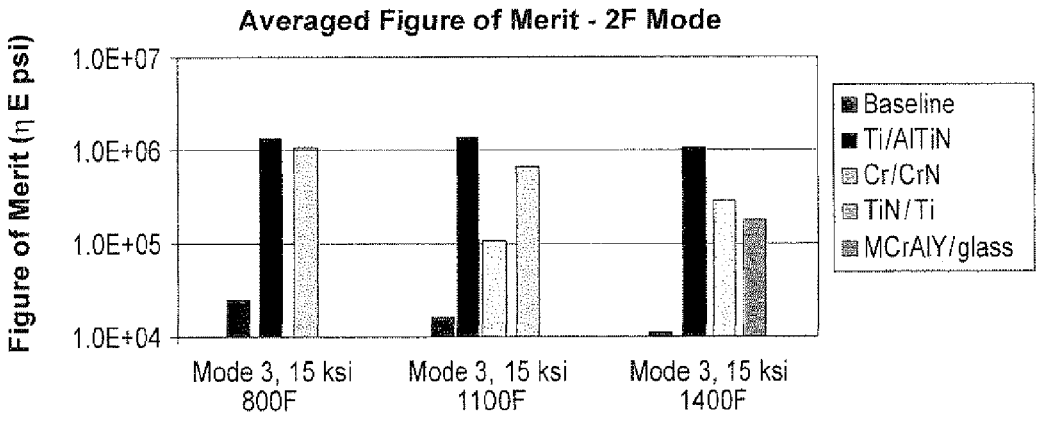
FIG. 6 compares the amount of damping provided by each surface layer with respect to untreated base plate under representative operating conditions in accordance with certain embodiments of the present invention.
Figure 7:
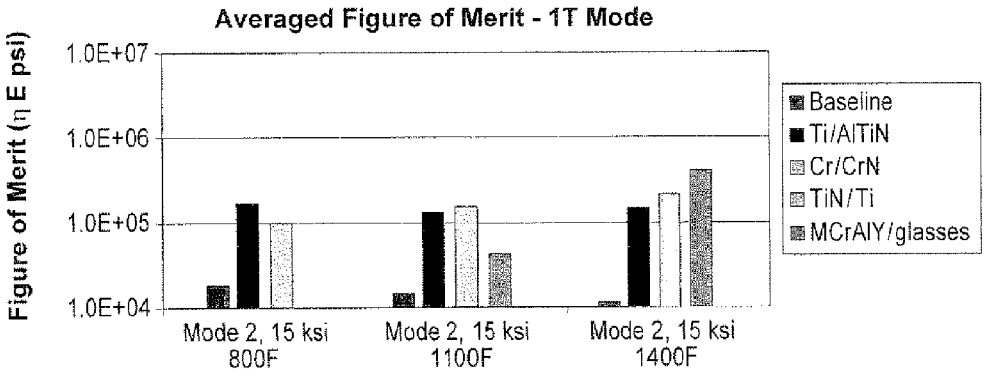
FIG. 7 compares the amount of damping provided by each surface layer with respect to untreated base plate under representative operating conditions in accordance with certain embodiments of the present invention.
Figure 8:
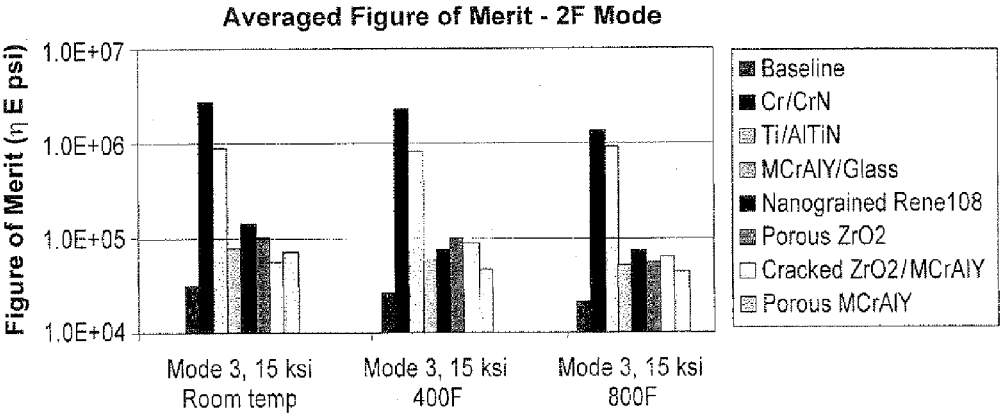
FIG. 8 compares the amount of damping provided by each surface layer with respect to untreated base plate under representative operating conditions in accordance with certain embodiments of the present invention.

FIGS. 6-8 summarize the vibration damping testing results from the surface layers described in Table 1. Figure of merit, Q, which takes into account the relative surface layer and base material Young's moduli, loss factor, and thickness is plotted for room temperature up to 1400° F. as a function of applied stress for second flex (2F) and first torsion (1T) modes. Figure of merit is determined according to the following formula:

$$\Delta Q \sim \frac{E_S \eta_S}{E_O \eta_O} \frac{h_S}{h_O}$$

where Q is the Figure of merit, $E_s$ is the Young's modulus of the surface layer (i.e., the ability to take vibrational energy), $E_o$ is the Young's modulus of the untreated base layer, η represents a loss factor (i.e., the ability to dissipate energy), and h is thickness.

All surface treatments described in Table 1 showed at least 50% damping improvement over untreated baseline material in all modes measured. Laser vibrometry measurements were done in high temperature oven where base materials were in the form of flat plates and were fixtured on a spring loaded floating table to make sure any fixture damping was eliminated.

FIGS. 2-5 schematically illustrate various structures for surface structure 14. As illustrated in FIG. 2, consecutive hard and soft layers 22 may be deposited on substrate 12 and may also be treated with a protective layer 40 depending on the operating conditions. In this example, alternating layers of 0.5 microns thick metallic Ti and 1 micron thick titanium aluminum nitride materials were applied by Northeast Coating Technologies, Kennebunk, Me. using their commercial PVD coater. Alternating layers of Titanium and AlTiN were applied to a total film thickness of 7 microns.

As illustrated in FIG. 3, heat, electrical or magnetic field, or pressure softenable material 16 may be incorporated into oxidation resistant metallic or ceramic material 18 and the resulting composite may be deposited on substrate 12 and then may also be treated with a protective layer 40 depending on the operating conditions. In this example, −140 mesh MCrAlY powder (SM4198) was mixed with −90 micron Qcel 6070 powder from The PQ Corporation, Conshohocken, Pa. After 60 grit $Al_2O_3$ grit blasting the substrate with 60 psi pressure, the powder mix was deposited onto the substrates using DJ2600 gun at 600 mm/s speed and 68 schf hydrogen fuel flow rate.

The glass particle size may range, for example, between 5 and 15 microns at 10%, between 25 to 45 microns at 50%, or between 65 and 90 microns at 90%.

Figure 4B:
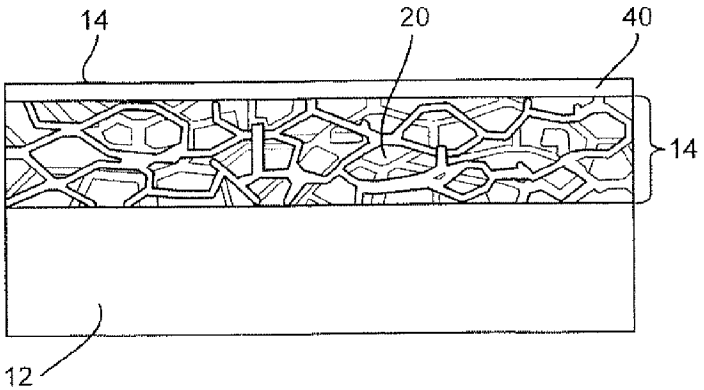
FIG. 4 is an illustration of a third example of a coating's metallurgical cross-section in accordance with an embodiment of the present invention.
Figure 4D:
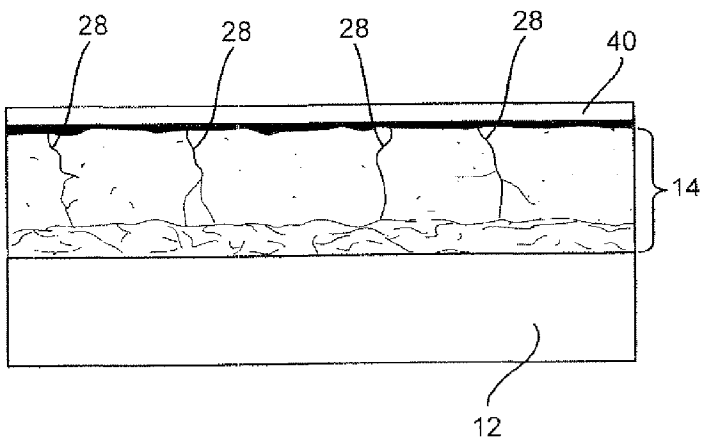
Figure 4A:
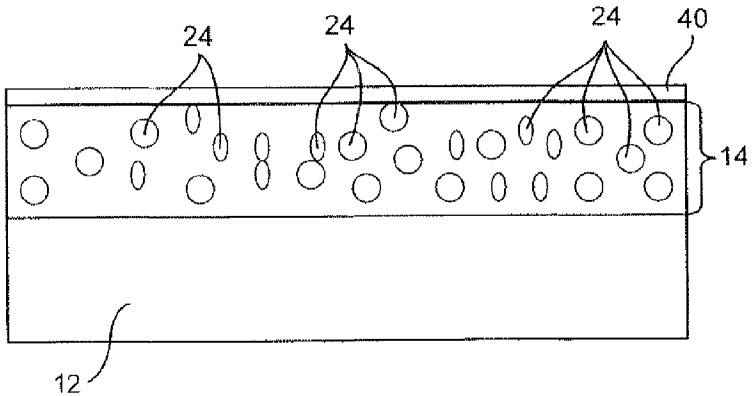
Figure 4C:
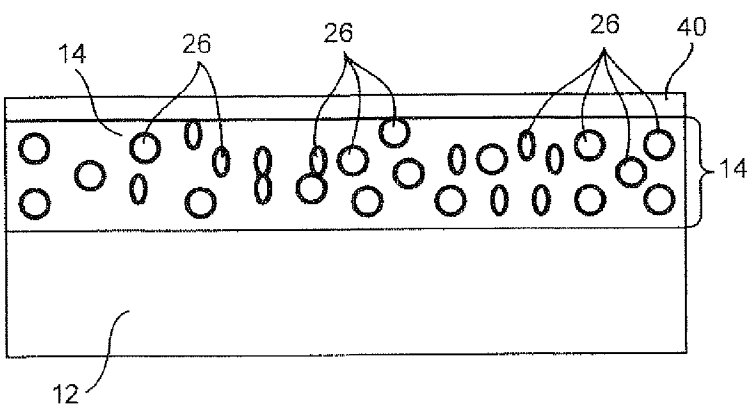

As illustrated in FIG. 4*a*, pores 24 may be incorporated in the surface structure 14, as can open cell or hollow sphere foams 20, as illustrated in FIG. 4*b*, or microballoons 26, as illustrated in FIG. 4*c*, or periodic vertical cracks 28, as illustrated in FIG. 4*d*. Pores 24 may include micropores having diameters of 0.5-100 microns, nanopores of diameters of 15-500 nm, and/or macropores having diameters greater than 100 microns. Pores can be inherent to the plasma spray processing of 204NS-G commercial zirconia powder using Argon at 79.8 SCFH rates as the primary gas. Pores can also be generated using sacrificial polymer particles during thermal spray processing to create the pores after polymer burn off step. Foams 20 may include metal/ceramic open cell foams (such as ones provided by Selee Corporation, Hendersonville, N.C.), hollow-sphere foams (such as those from Fraunhofer Corporation, Germany), and/or metal-infiltrated ceramic foams. Microballoons 26 may be a powder comprising clusters of glass spheres or hollow particles.

Additionally, as shown in FIG. 5, surface structure 14 may be applied to the airfoil substrate 12 using fine grained (grain boundaries 32) and dispersoid 34 filled powder particles. Cryomilling in liquid nitrogen can be used to impart dispersoids in the powder particle grains which could form a damping coating after HVOF spraying using 500 mm/s gun speed and oxygen (170 psi, 32 FMR) and hydrogen (140 psi, 70 FMR) as the fuel.

The damping surface structures 14 described above may be applied to the desired gas turbine components by a number of appropriate methods depending on the substrate material, desired surface layer material, and microstructure. These methods may include cathodic arc, pulsed electron beam physical vapor deposition (EB-PVD), slurry deposition, electrolytic deposition, sol-gel deposition, spinning, thermal spray deposition such as high velocity oxy-fuel (HVOF), vacuum plasma spray (VPS) and air plasma spray (APS). It is to be appreciated, however that other methods of coating application may be utilized within the scope of this invention. The surface structures may be applied to the desired component surfaces in their entirety or applied only to areas of the component to be damped.

In at least certain embodiments, the damping surface layer comprises a plurality of layers, wherein the plurality of layers comprises at least one hard layer comprising a ceramic layer and comprises at least one soft layer comprising a metal alloy. In at least certain embodiments, there are a plurality of layers comprising a layer of titanium, nickel, cobalt, iron, chromium, silicon, germanium, platinum, palladium, and/or ruthenium and comprises a layer of aluminum, titanium, nickel, chromium, iron, platinum, palladium, and/or ruthenium.

In at least certain embodiments, the damping surface layer includes a composite with a softenable phase, wherein the composite comprises an oxidation resistant metallic material, and wherein the softenable phase comprises a silica-based glass. In at least certain embodiments, the composite comprises nickel-chromium-aluminum-yttrium, cobalt-chromium-aluminum-yttrium, or nickel-chromium-aluminum-yttrium and optionally comprises platinum, palladium, ruthenium, or germanium.

In at least certain embodiments, the damping surface layer comprises a porous ceramic or metallic layer. In at least certain embodiments, the damping surface layer comprises a metal oxide. In at least certain embodiments, the damping surface layer comprises a zirconium oxide and/or aluminum oxide.

In at least certain embodiments, the damping surface layer comprises a cryomilled nickel-based, cobalt-based, or iron-based superalloy.

In at least certain embodiments, the gas turbine or turbine component of claim 1, wherein the damping surface layer comprises chromium and chromium-nitrogen.

All disclosed and claimed numerical amounts and ranges are approximate and include at least some degree of approximation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine or turbine component partially or fully coated with a damping surface layer, wherein the damping surface layer has a thickness between 0.1 and 2000 microns and is capable of dissipating vibration or modifying a resonance frequency of the gas turbine or turbine component at ambient room temperatures including operational temperatures greater than 500° F., and wherein the damping surface layer comprises at least one of (a) at least two layers comprising a first layer of at least one hard material and a second layer comprising at least one soft material, (b) a composite comprising a nickel alloy with a heat softenable chemistry, (c) a fine-grained nickel-based superalloy, or (d) a porous metallic coating, a porous metallic and ceramic coating, or a ceramic coating wherein the damping surface layer comprises a composite with a softenable phase, wherein the composite comprises an oxidation resistant metallic material, and wherein the softenable phase comprises a silica-based glass.

2. The gas turbine or turbine component of claim 1, wherein the damping surface layer comprises a plurality of layers, wherein the plurality of layers comprises at least one hard layer comprising a ceramic layer and comprises at least one soft layer comprising a metal alloy.

3. The gas turbine or turbine component of claim 2, wherein the plurality of layers comprises a layer of titanium, nickel, cobalt, iron, chromium, silicon, germanium, platinum, palladium, and/or ruthenium and comprises a layer of aluminum, titanium, nickel, chromium, iron, platinum, palladium, and/or ruthenium.

4. The gas turbine or turbine component of claim 2, wherein the damping surface layer has a thickness between 0.25 and 50 microns.

5. The gas turbine or turbine component of claim 1, wherein the composite comprises nickel-chromium-aluminum-yttrium, cobalt-chromium-aluminum-yttrium, or nickel-chromium-aluminum-yttrium and optionally comprises platinum, palladium, ruthenium, or germanium.

6. The gas turbine or turbine component of claim 1, wherein the damping surface layer has a thickness between 50 and 2000 microns.

7. The gas turbine or turbine component of claim 1, wherein the damping surface layer comprises a porous ceramic or metallic layer.

8. The gas turbine or turbine component of claim 7, wherein the damping surface layer comprises a metal oxide.

9. The gas turbine or turbine component of claim 8, wherein the damping surface layer comprises a zirconium oxide and/or aluminum oxide.

10. The gas turbine or turbine component of claim 7, wherein the damping surface layer comprises pores, cell or hollow sphere foams, microballoons, and/or vertical cracks.

11. The gas turbine or turbine component of claim 1, wherein the damping surface layer comprises dispersoids in powder particle grains.

12. The gas turbine or turbine component of claim 11, wherein the damping surface layer comprises a cryomilled nickel-based, cobalt-based, or iron-based superalloy.

13. The gas turbine or turbine component of claim 1, wherein the damping surface layer comprises chromium and chromium-nitrogen.

14. A method of making the gas turbine or turbine component of claim 1, the method comprising depositing a layer on a surface of the gas turbine or turbine component using cathodic arc deposition, pulsed electron beam physical vapor deposition, slurry deposition, electrolytic deposition, sol-gel deposition, spinning, thermal spray deposition such as high velocity oxygen fuel, vacuum plasma spray, or an air plasma spray.

15. The method of claim 14, wherein the step of depositing a layer comprises sequentially depositing a plurality of layers comprising at least one soft layer and at least one hard layer cathodic arc or ion plasma deposition techniques.

16. The method of claim 14, wherein the step of depositing a layer comprises: mixing a heat softenable particle with a transition phase with an oxidation resistant metallic and/or ceramic powder to form a mixture; and spraying the mixture onto the gas turbine or turbine component using a high velocity oxygen fuel process.

17. A gas turbine or turbine component partially or fully coated with a damping surface layer, wherein the damping surface layer has a thickness between 0.1 and 2000 microns and is capable of dissipating vibration or modifying a resonance frequency of the gas turbine or turbine component at operational temperatures greater than 500° F., and wherein the damping surface layer comprises at least one of (a) Ti and AlTiN, (b) Cr and CrN, (c) TiN and Ti, (d) MCrAlY and a glass powder, where M comprises Ni, Co, or Fe, (e) a nanograined nickel-based superalloy, (f) a porous zirconium oxide, (g) a cracked zirconium oxide optionally with MCrAlY, (h) a porous MCrAlY, or a mixture thereof.

* * * * *